United States Patent [19]

Birch et al.

[11] 4,278,532

[45] Jul. 14, 1981

[54] AIR CLASSIFICATION APPARATUS

[76] Inventors: Peter R. Birch, 56 High St., Ashwell, Near Baldock, Hertfordshire, SG7 5NR; Kenneth V. Ling, 132 Swifts Green Rd., Stopsley, Luton, Bedfordshire, LU2 8BP; Claude S. Power, 16 Newnham Way, Ashwell, Near Baldock, Hertfordshire, SG7 5PN; Alan J. Robinson, "Moonrakers", Garth Rd., Letchworth; Terrence G. Mahoney; Stanislaw F. Las-Laskowski, both of Green Dragon House, 64/70 High St., Croydon, Surrey, all of England

[21] Appl. No.: 41,692

[22] Filed: May 23, 1979

[30] Foreign Application Priority Data

May 25, 1978 [GB] United Kingdom ..... 22875/78

[51] Int. Cl.[3] ..... B07B 7/00

[52] U.S. Cl. ..... 209/19; 209/152; 209/473

[58] Field of Search ..... 209/473, 482, 152, 293, 209/294, 295, 134, 135, 136, 137, 147, 284, 466, 30–35, 154, 44, 19, 24–27, 153; 406/368

[56] References Cited

U.S. PATENT DOCUMENTS

| | | | |
|---|---|---|---|
| 813,955 | 2/1906 | Dean | 209/152 |
| 888,156 | 5/1908 | Gillette | 209/137 |
| 993,593 | 5/1911 | Guernsey | 209/473 |
| 1,186,874 | 6/1916 | Buel | 209/152 |
| 1,296,791 | 5/1919 | Grabert | 209/152 |
| 1,530,277 | 3/1925 | Mettler | 209/137 |
| 2,543,898 | 3/1951 | DeVaney | 209/288 X |
| 2,577,488 | 12/1951 | Stephenson | 209/473 X |
| 2,681,476 | 6/1954 | Van Doorn | 209/137 |
| 3,720,307 | 3/1973 | Mukhi | 209/135 X |
| 3,929,628 | 12/1975 | Derexi | 209/147 |
| 4,070,202 | 1/1978 | Nollet | 209/482 X |

FOREIGN PATENT DOCUMENTS

| | | | |
|---|---|---|---|
| 253356 | 6/1926 | United Kingdom | 209/152 |
| 387412 | 2/1933 | United Kingdom | 209/152 |
| 250060 | 12/1969 | U.S.S.R. | 209/136 |

*Primary Examiner*—Robert Halper

*Attorney, Agent, or Firm*—Brady, O'Boyle & Gates

[57] ABSTRACT

An air classifier comprising a rotatable open-ended drum disposed with its axis horizontal or substantially so, for receiving material to be classified, means for creating a stream of air through the drum, means for introducing material to be classified into the drum at or near the upstream end thereof, means in the drum for conveying materially axially of the drum during rotation thereof, the conveying means being in the form of helical vanes of mutually opposite hand arranged in an upstream part of the drum to convey "heavies" in counter-current to the stream of air through the drum and in a downstream part of the drum being arranged to convey "lights" in the direction of the air stream, the two helical vanes being separated by an annular member which projects radially inwards from the inner periphery of the drum.

22 Claims, 5 Drawing Figures

AIR CLASSIFICATION APPARATUS

The invention relates to air classification apparatus. In known classification systems for receiving mixed material, e.g. municipal waste, and separating the mixed material into various components, it is known to employ an inclined rotary drum through which air is passed while the materials are tumbled in the drum by internal paddles or lifters in order to separate the materials according to one or more of their physical properties, usually according to a function of density, size and (at high values of Reynolds numbers) drag co-efficient. Thus since heavy materials are substantially unaffected by the air stream they are tumbled to the lower end of the drum where they are discharged, whereas the lighter materials are entrained in the air stream and are discharged from the other end of the drum. More dense and less dense materials will, for ease of reference, be referred to as "heavies" and "lights" respectively.

According to the invention there is provided an air classifier comprising a rotatable open-ended drum disposed with its axis horizontal, or substantially so, for receiving material to be classified, means for creating a stream of air through the drum, means for introducing material to be classified into the drum at or near the upstream end thereof, means in the drum for conveying materially axially of the drum, the conveying means being arranged in an upstream part of the drum to convey "heavies" in counter-current to the stream of air through the drum and in a downstream part of the drum being arranged to convey "lights" in the direction of the air stream. The conveying means may comprise helical vanes of mutually opposite hand, the two helical vanes preferably being separated by an annular weir member which projects radially inwards from the inner periphery of the drum. The axial position of the weir in the drum may be adjustable. Each of the helical vanes or one or other of them may, if desired, be two or more start. The drum preferably comprises a trommel or screen section which is preferably located downstream of the weir member. The means for introducing the material to be classified into the upstream end of the drum may be a belt conveyor.

Preferably the interior surface of the drum is provided with lifters disposed generally normally to the helical vanes whereby during rotation of the drum the material is tumbled, that is to say, it is lifted and dropped into the air stream repeatedly as it passes through the drum whereby "lights" are entrained in the air stream and are exhausted from the downstream end of the drum. The lifters may extend between adjacent convolutions of the helical vanes but preferably extend only part way between adjacent convolutions. The vane at least at the upstream end of the drum may be of aerofoil shape, that is to say, inclined in the downstream direction. Alternatively or additionally the interior of the drum may be profiled to tumble the material during its passage through the drum. Alternatively, again, the drum may be polygonal in section, e.g. shaped as a regular octagon in order to tumble the material. Furthermore, if desired, the cross-section of the drum may vary along its axis, for example, so that the drum is barrel-shaped or waisted. A waisted shape may assist in providing a beneficial air-flow through the drum.

Preferably the means for creating a stream of air through the drum comprises a forced draught fan arranged to discharge air immediately below the means for introducing material into the drum whereby substantially the whole of the material entering the drum passes through the air stream. Where the means for conveying material axially of the drum comprises a helical vane, a secondary air inlet is preferably provided and which is disposed at or near the lower edge of the drum to blow air into the drum generally parallel to the adjacent end portion of the helical vane. Preferably the secondary air inlet is also inclined to the horizontal to direct air upwardly towards the axis of the drum. The primary air inlet preferably discharges air generally axially of the drum and is preferably of fishtail shape so as to encompass substantially the whole of the material introduced into the drum. The fishtail of the primary air inlet may be formed internally with splitters to ensure an even distribution of air exhausted from the fishtail. The secondary air inlet may be circular. If desired more than one secondary air inlet may be provided.

It is preferred to provide dampers downstream of the forced-draught fan to apportion the air between the primary and secondary inlets. The dampers may be such that the air to the primary and/or the secondary air inlets can be shut off. The arrangement of the primary and secondary air inlets may be such that their position vis-a-vis the drum can be adjusted.

The feed conveyor for the material to be classified is preferably a flat belt conveyor which can be adjusted for vertical position within the mouth of the drum and also axially of the drum. The speed of the drum may also be variable. The vertical positional adjustment of the conveyor may be effected by arranging the conveyor to be pivoted in a vertical plane about its rear end.

Air discharged from the downstream end of the drum preferably passes into a disengagement chamber from which air is exhausted by means of an induced draught fan, the arrangement being such that a negative pressure can be maintained within the chamber. The chamber may be formed with baffles to provide a labyrinth to assist in precipitation of particles from the air stream and preferably has a transverse curtain also to assist precipitation. The curtain may comprise a series of hanging rods or chains and is preferably graduated from top to bottom such that the pressure drop at the top of the curtain is greater than at its lower edge. Material precipitated in the disengagement chamber is preferably collected on a belt conveyor for discharge from the chamber.

To assist in maintaining a negative pressure in the disengagement chamber it is preferred to provide seals around the discharge aperture in the disengagement chamber and also in the screen or trommel section of the drum. It may also be advantageous to provide a sealing curtain at the mouth of the drum to assist in the maintenance of a negative pressure in the chamber.

If desired, air may be exhausted separately from the screen or trommel section of the drum, for example, by maintaining the exterior of that portion of the drum under negative pressure and if desired the exhausted air may be re-circulated via the primary and/or secondary air inlets. Air to the primary and/or secondary inlets may be heated if it is desired to dry the material to be classified and in addition a water mist or spray device may be provided in the drum to condition material which is too dry. Furthermore, material to be classified can be conditioned by spraying into the drum liquid waste material such, for example, as oil, solvents or paint.

A separate air inlet to the drum may, if desired, be provided for already air entrained "lights" a fraction of material to be separated.

The invention is diagrammatically illustrated, by way of example, in the accompanying drawings in which.

Figure 1:
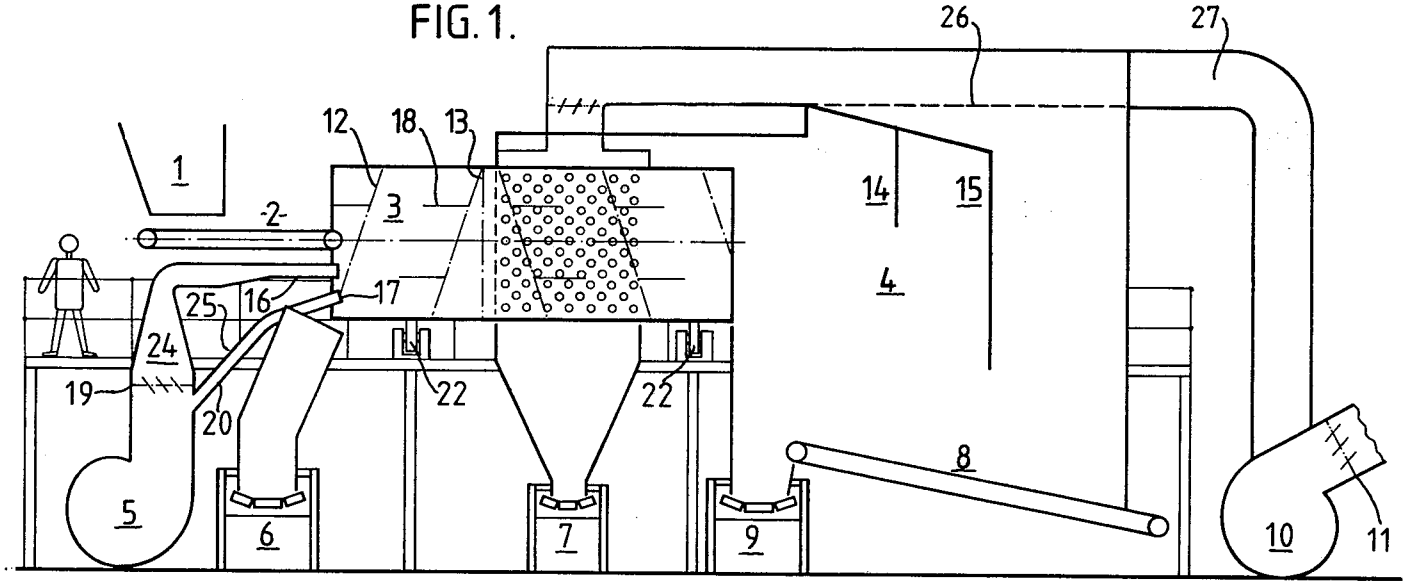
FIG. 1 is a cross-sectional side elevation of air classifying apparatus according to the invention.
Figure 2:
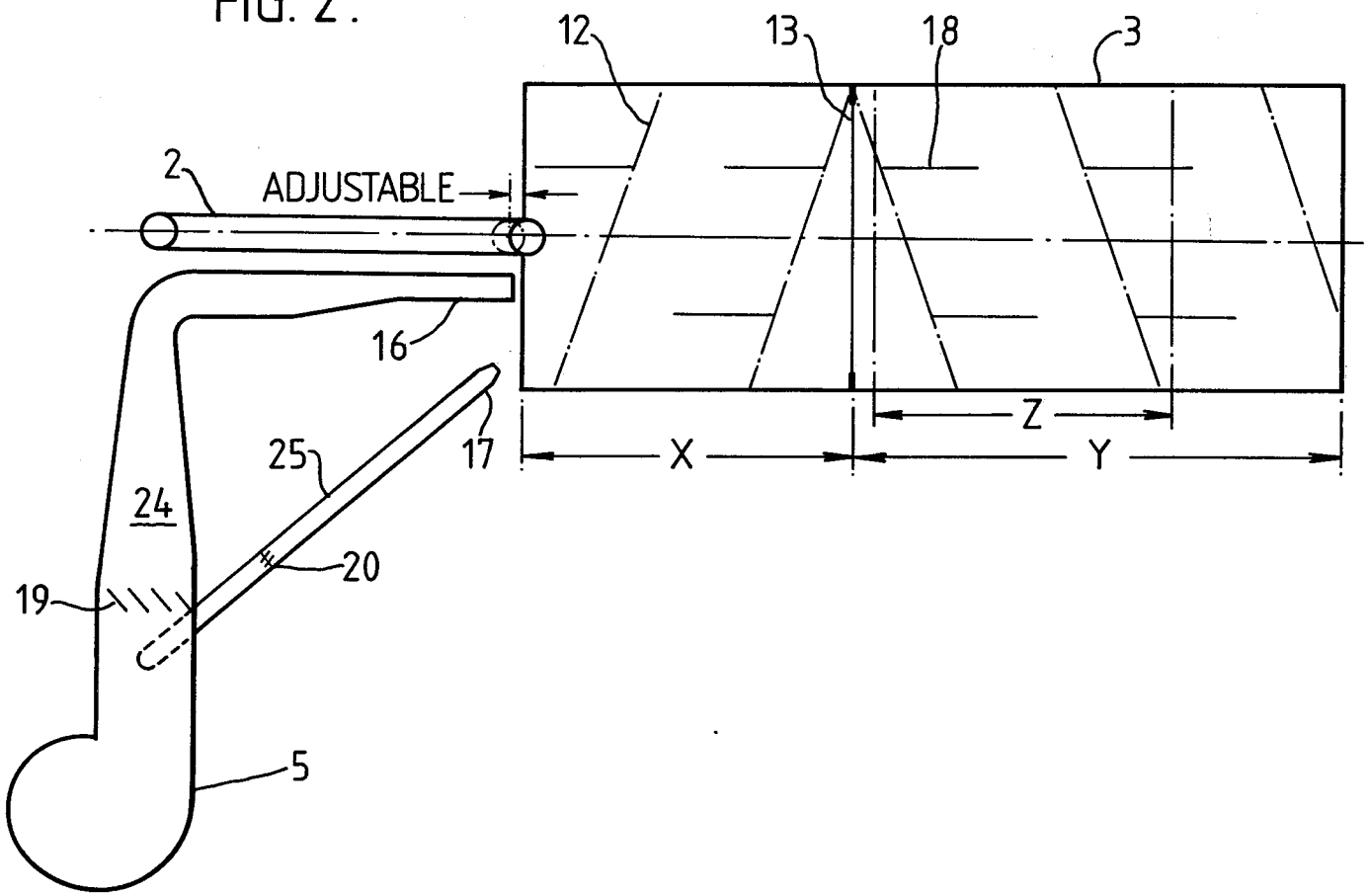
FIG. 2 is an enlarged side view of the classifying drum and air inlet arrangement of the apparatus shown in FIG. 1.
Figure 3:
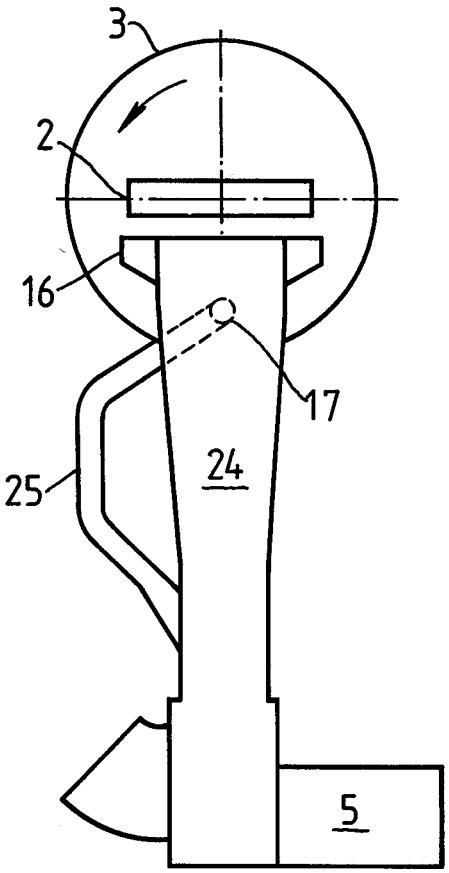
FIG. 3 is a front elevation of the apparatus of FIG. 2.
Figure 4:
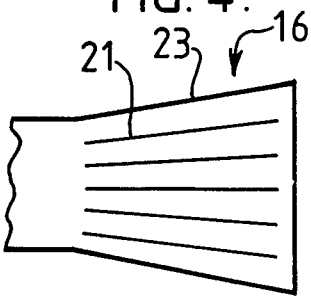
FIG. 4 is a scrap plan view of part of the air inlet arrangement shown in FIGS. 2 and 3.
Figure 5:
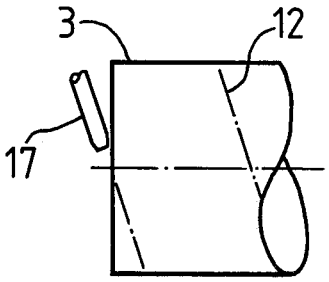
FIG. 5 is a scrap plan view of the front end of the classifying drum.

In the drawings there is shown air classifying apparatus for sorting mixed material, e.g. municipal waste, comprising a rotatable drum 3 in which the material is classified, the drum being mounted with its axis horizontal on pairs of rollers 22 and driven in rotation by an electric motor (not shown). It is preferred that a variable speed gear-box is employed so that the speed of the drum can be adjusted as desired. Material to be classified in the drum 3 is fed to the drum through a chute 1 which discharges on to a flat belt conveyor 2 which is mounted substantially on the axis of the drum 3 and with its nose portion adjacent to the front end of the drum. A forced-draught fan 5 is mounted below the conveyor 2 and is arranged to discharge air into the mouth of the drum via primary and secondary air inlets 16 and 17 respectively, to create a stream of air through the drum. The primary air inlet 16 is disposed immediately below the conveyor 2 and has a broad outlet section in the form of a fishtail 23 (see FIG. 4) so that substantially the whole of the burden of material discharged from the end of the conveyor 2 will pass through the primary air stream as it falls into the drum. To ensure that the fishtail outlet section of the primary air inlet 16 evenly distributes air into the mouth of the drum, the fishtail is formed with a number of flow splitters 21 which divide the air stream into a number of components. The secondary air inlet 17 comprises a relatively small circular nozzle which is directed at a heavy fraction of the material for the purpose which will appear hereinafter.

The internal periphery of the drum is formed with axial conveying means in the form of helical scrolls or vanes 12. In an inlet or up-stream section X of the drum the helical vane is arranged such that on rotation of the drum the vane tends to move material in the drum in counter-current to the stream of air through the drum. The secondary air inlet is directed at the heavy fraction of material discharged by the helical vane from the inlet end of the drum and for this purpose the secondary air inlet is arranged at the lower edge of the drum to discharge air substantially parallel to the leading section of the helical vane 12 and is angled towards the axis of the drum. The inlet section of the drum is terminated by an annular weir 13 which is designed to prevent entry of "heavies" into a downstream portion Y of the drum in which the helical vane 12 is arranged so that on rotation of the drum the material is conveyed axially of the drum and in the direction of the air-flow. The downstream portion Y of the drum includes a portion immediately adjacent to the weir 13 in which the surface of the drum is perforated to provide a trommel or screening section Z in which fine material is sieved out under the influence of gravity.

Light material is discharged from the drum 3 into a disengagement chamber 4 from which air is exhausted by means of an induced draught fan 10 in an exhaust duct 27 and by means of which the disengagement chamber can be maintained at a subatmospheric pressure. The chamber 4 is formed with a transverse baffle 14 around which air must pass before it is exhausted from the chamber and with a transverse curtain 15 which is graduated from its top to its bottom to present a greater resistance to airflow at its top than is provided at its bottom. Suitably the curtain 15 may comprise a series of elongate, preferably flexible, members e.g. hanging chains or rods. The purpose of the baffle and the curtain is to precipitate dust particles from the air and to disengage any residual "fliers" before the air is discharged to atmosphere, so as to minimise the need for further air filtration. A perforated plate 26 covers the exit of the disengagement chamber into the duct 27 as a final filter for light material.

Heavies discharged from the upstream or front end of the drum are fed via a chute to a belt conveyor 6 for discharge from the apparatus. Fines passing through the trommel or screen section Z of the drum are fed via a chute to a conveyor 7 for discharge from the apparatus, and "lights" discharged into the disengagement chamber 4 are collected by an inclined conveyor 8 and fed to a conveyor 9 for discharge.

In operation mixed material to be classified e.g. municipal waste material, is fed at high speed into upstream end X of the rotating drum 3 by means of the conveyor 2 and in falling into the drum passes through the primary air stream from the primary inlet 16 so that the "lights" component of the material (e.g. paper) is conveyed rapidly through the drum. The heavy component of the material ("heavies" ) drops into the drum since it is relatively unaffected by the air stream and is conveyed back out of the mouth of the drum against the stream of air under the action of the helical vane 12. During this period the material is tumbled by lifters 18 formed on the internal surface of the drum and which extend generally normally of the helical vane. This tumbling action causes the material to be re-presented to the air stream at frequent intervals to remove from the heavy component any remaining light material. As the heavy component is discharged from the front end of the drum into the chute it is subjected to the secondary air stream from the secondary inlet 17 for removal into the air stream of remaining light material. The annular weir 13 ensures that the heavy component does not pass into the downstream portion Y of the drum but the lighter fraction of the material is blown over the weir into the downstream section of the drum. The lighter material comes under the influence of the helical vane 12 in the downstream section and is conveyed towards the downstream end of the drum. During this period the material is agitated by means of lifters 18 similar to those in the upstream portion of the drum to improve the screening efficiency. Immediately downstream of the weir the material enters the trommel or screening section Z of the drum in which fine particles in the material fall through the perforations in the drum under gravity and are collected on a discharge conveyor 7.

The remaining portion of the charge, e.g. "lights" is discharged from the downstream end of the drum into the disengagement chamber 4 in which it falls onto a conveyor 8 for discharge from the apparatus on a conveyor 9 for possible further treatment, e.g. in a wastederived fuel pelletizer. To ensure that any remaining dust is extracted from the air before the air is discharged to atmosphere the air is constrained to pass around the baffle 14 and then through, or around, the curtain 15 so that the remaining dust particles are precipitated from the air stream, and any remaining fliers are disengaged before the air is exhausted to atmosphere by the induced-draught fan 10. In this connection it is preferred to use the air classifier in association with a primary trommel in which the material undergoes a preliminary sorting in which much of the dust is removed before the material is fed to the air classifier. Under overload conditions small fragments of paper might tend to obstruct the perforated plate 26 and to overcome this it might be desirable to provide an air by-pass duct between the trommel or screening section and the exhaust duct 27. It is thought that the by-pass may help to keep the "lights" loose during screening thereby improving screening efficiency. Certainly the air velocity at the perforated plate 26 will be reduced by the by-pass, thereby reducing the rate of build-up of entrained paper fragments on the perforated plate. Any tendency of the trommel or screening section to become obstructed with paper fragments will be countered by the rotation of the drum which will take the fragments out of the airstream and bring them under the influence of the helical vane 12.

To ensure that the subatmospheric pressure is maintained in the disengagement chamber the rating of the induced draught fan 10 is greater than the rating of the forced draught fan 5 and a pressure sensor is provided in the disengagement chamber to monitor the pressure in the chamber. Dampers are provided both on the forced draught fan and the induced draught fan so that if the pressure in the chamber 4 tends to go positive the system can be adjusted automatically. As a further aid to the maintenance of an underpressure in the disengagement chamber it is preferred to seal the various outlets from the drum and from the disengagement chamber and also to provide a simple curtain at the mouth of the drum to limit entry of air.

It will be seen that the forced draught fan 5 is connected to the primary and secondary inlets respectively via conduits 24 and 25 respectively, dampers 19 and 20 respectively being provided in the conduits so that the air flow can be adjusted. Similarly the induced draught fan 10 is provided with a damper 11 arranged downstream of the fan.

We claim:

1. An air classifier comprising a rotatable open-ended drum disposed with its axis substantially horizontal, for receiving material to be classified, means for creating a stream of air through the drum, means for introducing material to be classified into the drum near the upstream end thereof, means in the drum for conveying materially axially of the drum during rotation thereof, the conveying means comprising first and second helical vanes of mutually opposite hand, said first helical vane disposed in an upstream part of the drum to convey "heavies" in counter-current to the stream of air through the drum and said second helical vane disposed in a downstream part of the drum to convey "lights" in the direction of the air stream, a primary air inlet discharging air into the drum, and a secondary air inlet adjacent to the primary air inlet and disposed near the lower edge of the drum to direct air into the drum generally parallel to the upstream end portion of the first helical vane.

2. An air classifier according to claim 1, wherein the two helical vanes are separated by an annular member which projects radially inwards from the inner periphery of the drum.

3. An air classifier according to claim 2, wherein the drum comprises a trommel section.

4. An air classifier according to claim 3, wherein the trommel section is located downstream of the annular member.

5. An air classifier according to claim 1, wherein the means for introducing material to be classified into the upstream end of the drum is a variable speed conveyor.

6. An air classifier according to claim 5, wherein the conveyor includes adjustable mounting means for adjusting the conveyor for vertical position within the mouth of the drum.

7. An air classifier according to claim 6, wherein the vertical adjustment of the conveyor is effected by arranging the conveyor to be pivoted for movement in a vertical plane about its rear end.

8. An air classifier according to claim 5, wherein the conveyor is a flat belt conveyor.

9. An air classifier according to claim 1, wherein the interior surface of the drum is provided with lifters disposed substantially normally to the helical vanes.

10. An air classifier according to claim 9, wherein the lifters extend only part way between adjacent convolutions of the helical vanes.

11. An air classifier according to claim 1, wherein the helical vane at the upstream end of the drum is inclined in the downstream direction.

12. An air classifier according to claim 1, wherein the drum is polygonal in section in order to tumble the material during its passage through the drum.

13. An air classifier according to claim 1, wherein the means for creating a stream of air through the drum includes a forced draught fan arranged to discharge air into the drum through said primary air inlet immediately below the means for introducing material into the drum whereby substantially the whole of the material entering the drum passes through the air stream.

14. An air classifier according to claim 1, wherein the secondary air inlet is also inclined to the horizontal to direct air upwardly towards the axis of the drum.

15. An air classifier according to claim 1, wherein the primary air inlet is of fishtail shape so as to ensure that the air stream therefrom encompasses substantially the whole of the material discharged into the drum.

16. An air classifier according to claim 15, wherein the fishtail end of the primary air inlet is formed internally with flow splitters to ensure an even distribution of the air discharged therefrom.

17. An air classifier according to claim 1, comprising a disengagement chamber into which air discharged from the downstream end of the drum passes and from which air is exhausted by means of an induced draught fan, the arrangement being such that a negative pressure can be maintained within the chamber.

18. An air classifier according to claim 17, wherein the chamber is formed with a baffle to deflect the air stream to assist in precipitation of particles and/or fliers from the air stream.

19. An air classifier according to claim 17, wherein the disengagement chamber has a transverse curtain to assist precipitation of particles and/or fliers from the air stream.

20. An air classifier according to claim 19, wherein the curtain comprises a series of elongate members.

21. An air classifier according to claim 1, comprising a separate air inlet to the drum for an already air entrained "lights" fraction of material to be classified.

22. An air classifier comprising a rotatable open-ended drum disposed with its axis substantially horizontal, for receiving material to be classified, means for creating a stream of air through the drum, means for introducing material to be classified into the drum near the upstream end thereof, means in the drum for conveying materially axially of the drum during rotation thereof, the conveying means comprising first and second helical vanes of mutually opposite hand, said first helical vane disposed in an upstream part of the drum to convey "heavies" in counter-current to the stream of air through the drum and said second helical vane disposed in a downstream part of the drum to convey "lights" in the direction of the air stream, a primary air inlet discharging air into the drum, a secondary air inlet adjacent to the primary air inlet and disposed near the lower edge of the drum to direct air into the drum generally parallel to the upstream end portion of the first helical vane, a trommel section in the downstream part of the drum, a disengagement chamber into which air discharged from the downstream end of the drum passes, an induced draught fan, by means of which air is exhausted from the disengagement chamber, an exhaust duct connecting the disengagement chamber and the induced draught fan, the arrangement being such that a negative pressure can be maintained within the disengagement chamber, and an air by-pass duct between the trommel section and the exhaust duct.

* * * * *